US007292201B2

(12) United States Patent
Nagaev et al.

(10) Patent No.: US 7,292,201 B2
(45) Date of Patent: Nov. 6, 2007

(54) DIRECTIONAL ANTENNA SYSTEM WITH MULTI-USE ELEMENTS

(75) Inventors: Farid I. Nagaev, St. Petersburg (RU); Oleg Y. Abramov, St. Petersburg (RU); Pertti Visuri, Fallbrook, CA (US)

(73) Assignee: Airgain, Inc., Carlsbad, CA (US)

( * ) Notice: Subject to any disclaimer, the term of this patent is extended or adjusted under 35 U.S.C. 154(b) by 0 days.

(21) Appl. No.: 11/209,352

(22) Filed: Aug. 22, 2005

(65) Prior Publication Data

US 2007/0040760 A1 Feb. 22, 2007

(51) Int. Cl.
*H01Q 19/10* (2006.01)

(52) U.S. Cl. ..... 343/818; 343/810; 343/876

(58) Field of Classification Search ..... 343/876, 343/745, 810, 811, 812, 813, 818, 819, 834, 343/836, 835

See application file for complete search history.

(56) References Cited

U.S. PATENT DOCUMENTS

| | | | | |
|---|---|---|---|---|
| 3,996,592 | A * | 12/1976 | Kline et al. | 343/817 |
| 5,220,335 | A | 6/1993 | Huang | |
| 6,094,176 | A | 7/2000 | Van Hoozen et al. | |
| 6,275,192 | B1 | 8/2001 | Kim | |
| 6,292,153 | B1 | 9/2001 | Aiello et al. | |
| 6,362,790 | B1 | 3/2002 | Proctor, Jr. et al. | |
| 6,515,635 | B2 * | 2/2003 | Chiang et al. | 343/834 |
| 6,700,550 | B2 * | 3/2004 | Crowley | 343/792.5 |
| 6,888,511 | B2 | 5/2005 | Cake | |
| 7,050,018 | B2 * | 5/2006 | Weit | 343/876 |
| 2002/0024468 | A1 | 2/2002 | Palmer et al. | |
| 2003/0184492 | A1 * | 10/2003 | Chiang et al. | 343/833 |

FOREIGN PATENT DOCUMENTS

| | | | |
|---|---|---|---|
| CH | 690 945 | A5 | 2/2001 |
| EP | 0 901 185 | A1 | 3/1999 |
| EP | 0 936 693 | A1 | 8/1999 |
| EP | 1 069 646 | A2 | 1/2001 |
| RU | 2 144 721 | C1 | 1/2000 |
| RU | 2 156 524 | C2 | 9/2000 |

* cited by examiner

*Primary Examiner*—Hoanganh Le
(74) *Attorney, Agent, or Firm*—Richard E. Campbell; Procopio, Cory, Hargreaves & Savitch LLP

(57) ABSTRACT

Systems and methods for a wireless communication device having a switched multi-beam antenna and methods for manufacturing the same are described. One system and method includes a plurality of antenna of elements. Groups of the antenna elements cooperate to form active one or more antenna elements while other groups of the antenna elements cooperate to form a reflector for the active antenna elements. This creates a directed transmission or direction of positive gain for the antenna system. The same group of antenna elements can be switched so that other antenna elements cooperate to form the active element while another group forms a reflector for the active elements thereby providing a different direction of positive gain. The system can be used for various wireless communication protocols and at various frequency ranges.

13 Claims, 5 Drawing Sheets

DIRECTIONAL ANTENNA SYSTEM WITH MULTI-USE ELEMENTS

FIELD OF THE INVENTION

This invention relates to wireless communication systems including directional antennas useful in such systems.

BACKGROUND OF THE INVENTION

In wireless communication systems, antennas are used to transmit and receive radio frequency signals. In general, the antennas can be omni-directional or unidirectional. In addition, there exist antenna systems which provide directive gain with electronic scanning rather than being fixed. However, many such electronic scanning technologies are plagued with excessive loss and high cost. In addition, many of today's wireless communication systems provide very little room for antennae elements.

Traditional Yagi-Uda arrays consist of a driven element (by this we mean a signal is fed to the element by a transmitter or other signal source), called the driver or antenna element, a reflector, and one or more directors. The reflector and directors are not driven, and are therefore parasitic elements. By choosing the proper length and spacing of the reflector from the driven element, as well as the length and spacing of the directors, the induced currents on the reflector and directors will re-radiate a signal that will additively combine with the radiation from the driven element to form a more directive radiated beam compared to the driven element alone. The most common Yagi-Uda arrays are fabricated using a dipole for the driven element, and straight wires for the reflector and directors. The reflector is placed behind the driven element and the directors are placed in front of the driven element. The result is a linear array of wires that together radiate a beam of radio frequency (RF) energy in the forward direction. The directivity (and therefore gain) of the radiated beam can be increased by adding additional directors, at the expense of overall antenna size. The director can be eliminated, which leads to a smaller antenna with wider beam width coverage compared to Yagi antennas utilizing directors. The dipole element is nominally one-half wavelength in length, with the reflector approximately five percent longer than the dipole and the director or directors approximately five percent shorter than the dipole. The spacing between the elements is critical to the design of the Yagi and varies from one design to another; element spacing will vary between one-eighth and one-quarter wavelength.

SUMMARY OF THE INVENTION

The present invention includes a method, apparatus and system as described in the claims.

Briefly in one embodiment, An antenna system and method are provided that permit a variably directed antenna beam using elements of the antenna for different purposes in different configurations. I one aspect, a configurable antenna system includes a first compound antenna element including a first upper element, a first lower element and a first switch controllably coupling the first upper element and the first lower element. A second compound antenna element includes a second upper element, a second lower element and a second switch controllably coupling the second upper element and the second lower element. The first upper element and the second upper element are coupled by an upper conductive path. The first lower element and the second lower element are coupled by a lower conductive path.

Other embodiments are shown, described and claimed herein.

BRIEF DESCRIPTION OF THE DRAWINGS

These and other aspects, advantages and details of the present invention, both as to its structure and operation, may be gleaned in part by a study of the accompanying drawings, in which like reference numerals refer to like parts. The drawings are not necessarily to scale, emphasis instead being placed upon illustrating the principles of the invention.

DETAILED DESCRIPTION OF THE PREFERRED EMBODIMENTS

Certain embodiments as disclosed herein provide for systems and methods for a wireless communication device having a switched multi-beam antenna and methods for manufacturing the same. For example one system and method described herein provides for a plurality of antenna of elements. Groups of the antenna elements cooperate to form active one or more antenna elements while other groups of the antenna elements cooperate to form a reflector for the active antenna elements. This creates a directed transmission or direction of positive gain for the antenna system. The same group of antenna elements can be switched so that other antenna elements cooperate to form the active element while another group forms a reflector for the active elements thereby providing a different direction of positive gain. The system can be used for various wireless communication protocols and at various frequency ranges. For example, the system can be used at frequency ranges and having bands centered around 2.4 Ghz, 2.8 Ghz and 5.8 Ghz.

After reading this description it would become apparent to one skilled in the art how to implement the invention in various alternative embodiments and alternative applications. However, although various embodiments of the present invention will be described herein, it is to be understood that these embodiments are presented by way of example only, and not limitations. As such, this detailed description of various embodiments should not be construed to limit the scope or breadth of the present invention.

Figure 1A:
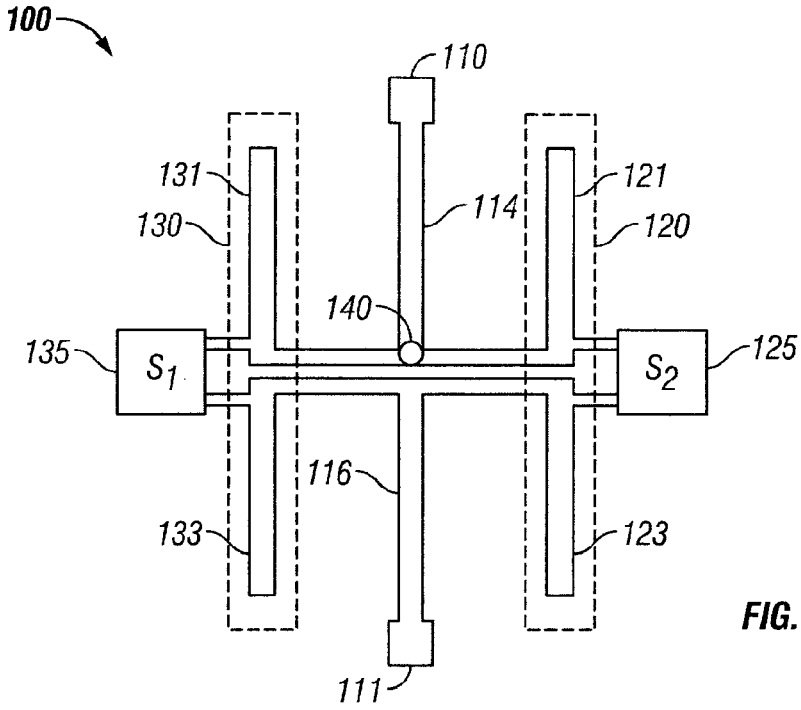
FIG. 1A is a representation of a directional antenna system.

Turning now to the figures, FIG. 1A is a representation of a configurable antenna 100. A first compound antenna element 120 includes an upper or first antenna element 121 and a lower or second antenna element 123. The two antenna elements are coupled by a switch 125. A second compound antenna element 130 also includes an upper or first antenna element 131 and a lower or second antenna element 133. The two antenna elements are coupled by a switch 135. The two upper elements 121 and 131 can be part of the same signal path and the two lower element 123 and 133 can be part of the same signal path. A signal source, such as a transmitter or radio, is coupled to the first antenna element 121 by a conductive path 114 at signal or RF input 110. The conductive path between the signal source and the element 121 can be accomplished with a strip line, a coaxial cable, or other suitable transmission media. The signal source 110 is also coupled with the other upper t antenna element 131. The transmission path between the transmission source and antenna element 131 can be of the same type as to antenna element 121. The lower antenna elements 123 and 133 are coupled to input 111 by conductive path 116. The two lower elements can be coupled to a virtual ground with regard to the RF signal.

The first switch 135 is located between antenna element 131 and antenna element 133. In the embodiment depicted in FIG. 1, the switch 135 is coupled to virtual ground through antenna element 133. Alternatively, it can be coupled to ground via a different path. Similarly, a second switch 125 is located between antenna element 121 and antenna element 123. When either of the switches 135 and 125 are closed, their corresponding antenna elements are coupled together. In one embodiment, all of the antenna elements 121, 123, 131, and 133 are in the same plane. In another embodiment, antenna elements 121 and 131 are in one plane and antenna elements 123 and 133 are in a different plane. The two planes can be parallel.

The distance from the feeding point 140 to antenna element 131 and to antenna element 121 is a reflective distance of approximately one-quarter wavelength ($\lambda_d/4$) of the transmitted signal in the transmission path. For example, distance can be $0.30\lambda_d$, $0.29\lambda_d$, $0.28\lambda_d$, $0.27\lambda_d$, $0.26\lambda_d$, $0.24\lambda_d$, $0.23\lambda_d$, $0.22\lambda_d$, $0.21\lambda_d$, or $20\lambda_d$. Therefore, when the antenna elements 131 or 121 are coupled to there corresponding antenna elements 133 and 123, respectively, by their respective switches, an electrical open is seen looking back towards the feeding point 140 from the antenna elements 131 and 121. Therefore, the reflective distance between feeding point 140 and the antenna elements 131 and 121 can be selected taking into account the frequency range(s) in which the antenna will be used, the dielectric constant of the transmission path and the desired efficiency of the antenna system. In one example, the reflective distance from each of the elements 121 and 131 to the feeding point is $\lambda_d/4$, where $\lambda_d$ is the center frequency of the frequency band for which the antenna system is intended to be used.

Each of the antenna element pairs 130 and 120 can operate as an active antenna element such as a dipole. Each of the antenna element pairs can also act as a reflector. When switch 135 is closed, coupling antenna element 131 to antenna element 133, the antenna element pair 130 is configured as a reflector and the element pair 120 (with the second switch 125 open) acts as the active antenna element (in this example, a dipole). This produces a directional antenna. When switch 125 is closed, coupling antenna element 121 to antenna element 123, the antenna element pair 120 is configured as a reflector and the element pair 130 (with the switch 135 open) acts as the active antenna element. This produces a directional antenna. Alternatively, both antenna element pairs can be active elements at the same time, switches 125 and 135 both open, to act as an omni-directional antenna.

Figure 1B:
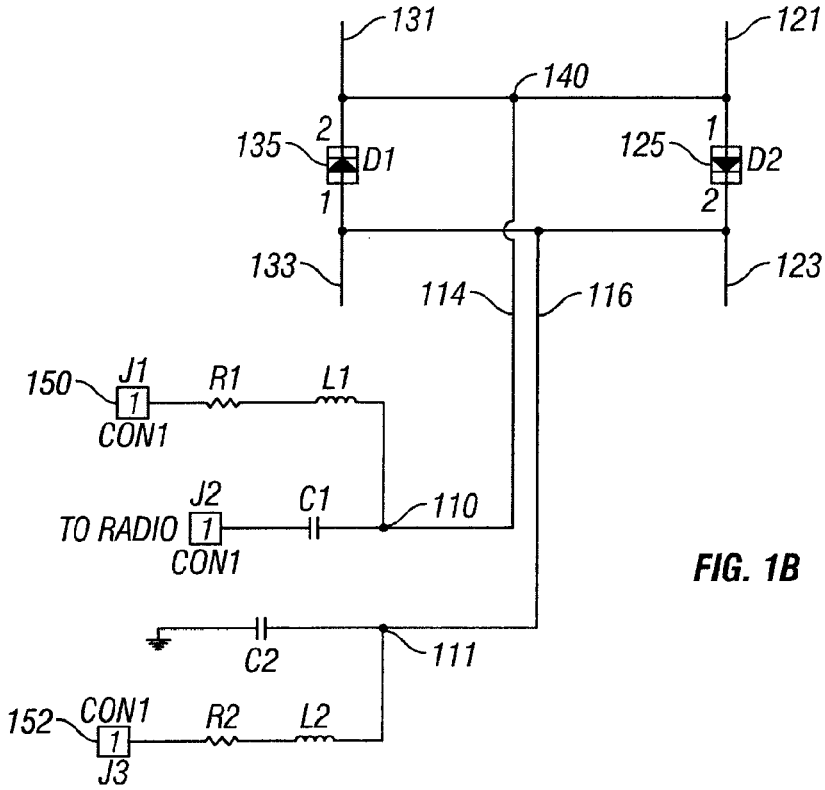
FIG. 1B is a schematic representation of the directional antenna system of FIG. 1B.

FIG. 1B is a schematic drawing of an embodiment of the antenna system of FIG. 1A in which like parts are given the same reference numbers. In this embodiment, switch 125 and switch 135 are pin diodes. The voltage which controls the state (open or closed) of the pin diodes is supplied across inputs 150 and 152. The pin diodes are installed in opposite orientation to each other. Therefore, the pin diodes respond in the opposite manner to the control voltages. A control voltage which biases switch 125 open biases switch 135 closed and a control voltage which biases switch 125 closed biases switch 135 open. The RF signal is isolated from the control voltage by capacitor C1 and the control voltages are isolated from the RF signal by inductors L1 and L2.

Figure 2:
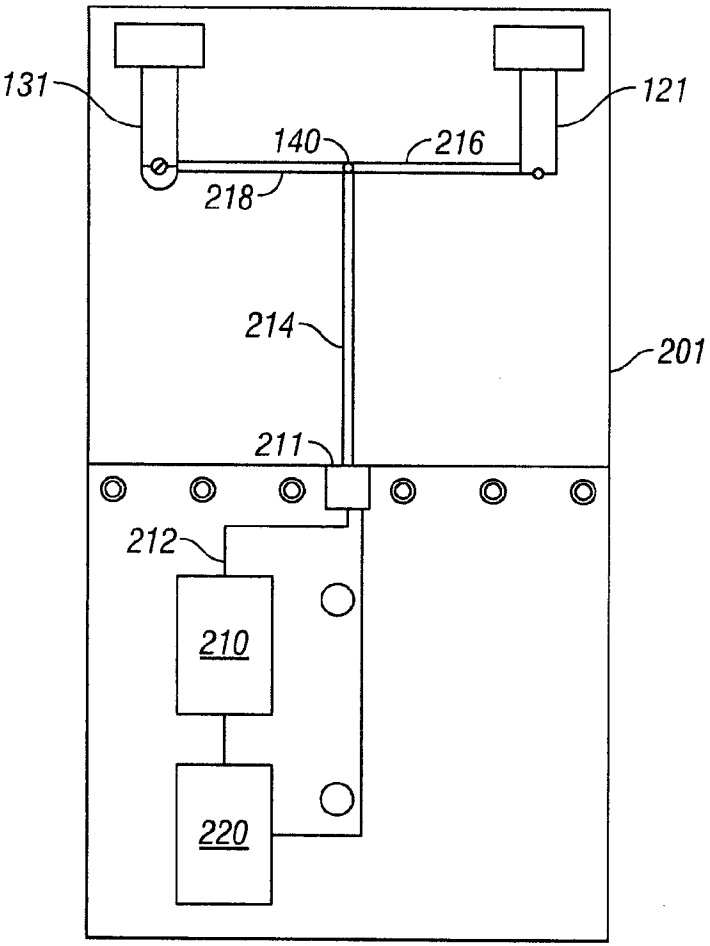
FIG. 2 is a top view of a wireless communication device having a directional antenna system.

FIG. 2 is a top view of an antenna system located on a supporting structure 201, for example, a printed circuit board, such as a Cardbus card or a PCMCIA card. In one embodiment, the card 201 includes the elements or components of a wireless network card including a radio 210 and a controller 220. The radio is coupled to the feeding point 140 via a coaxial cable 212 which is coupled to a strip line 214 at a connector 211. A first strip line 216 runs from the feeding point 140 to the first antenna element 121. A second strip line 218 runs from the feeding point 140 to antenna element 131. Approximate dimensions for one embodiment of the system for use with a frequency band centered around 2.4 GHz are shown on the figure.

Figure 3:
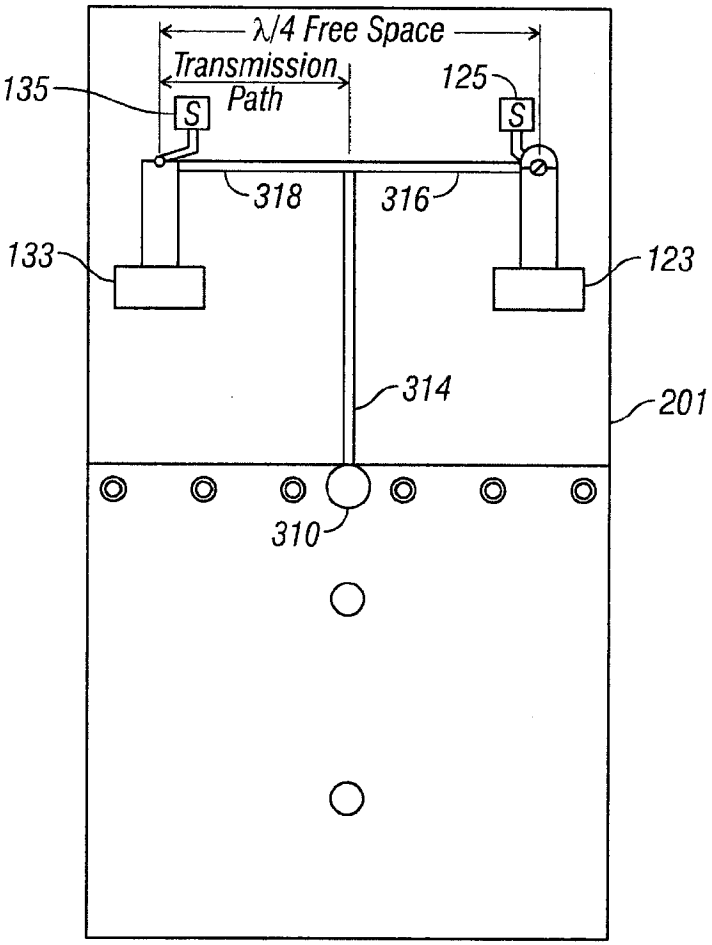
FIG. 3 is a bottom view of the wireless communication device of FIG. 2.

FIG. 3 is a bottom view of the board 201 depicted in FIG. 2. A ground connection 310 is coupled to antenna elements 133 and 123 via conductive paths 314, 316, and 318. The conductive paths 314, 316, and 318 are complementary to and form the ground plane portion of the strip line connections shown in FIG. 2. A switch 125 is shown coupled to antenna element 123. The switch is also coupled to antenna element 121 on the top of the board. The connection can be provided, for example, through a via in the circuit board. The switch can be a pin diode switch or any other type of suitable switch, for example a transistor switch or a micro-electromechanical switch. A second switch 135 is also provided which is coupled to antenna element 133. The switch is also coupled to antenna element 131 shown in FIG. 2. As with switch 125, that connection can be made through a via in the circuit board or through another suitable pathway. Switch 135 can also be a pin diode switch or any other type of suitable switch. In one embodiment, each of the switches 135 and 125 include control lines, not shown, coupling them to either the radio 210 or the controller 220. The control lines provide the signal which causes the switch to open or close. Depending on the radio 210 and the controller 220 selected for the system, either one can generate those signals. In another embodiment as was described above in connection with FIG. 1A, the switches are pin diodes and the DC biasing voltages (control signals) which control the state of the switches (for example, open or closed) are supplied over the same conductive paths which transmit the RF signals. This approach eliminates control lines in the immediate vicinity of the antenna elements. The control signals can be supplied, for example, across connector 211 and ground connection 310. For example, the controller 220 in FIG. 2 is shown connected to the connector 211 to provide the control signals. A similar connection is also provided from the controller 220 to the ground connection 310 (not shown). Because the control signals are essentially a DC bias, they can be supplied on the same path as the RF signals without causing and interference.

When switch 135 is open, antenna elements 133 and 131 cooperate to form a dipole antenna element. Similarly, when switch 125 is open antenna elements 123 and 121 cooperate to form a dipole element. Conversely, when switch 135 is closed, antenna elements 131 and 133 form a reflector for the dipole formed by antenna elements 121 and 123. Similarly, when the switch 125 is closed antenna elements 121 and 123 form a reflector for the dipole formed by antenna elements 131 and 133. Approximate dimensions for one embodiment of the system for use with a frequency band centered around 2.4 GHz are shown on the figure.

The antenna elements depicted in FIGS. 2 and 3 can be formed on a printed circuit board, for example, by any of the techniques used to form electrical traces on circuit boards.

Figure 4:
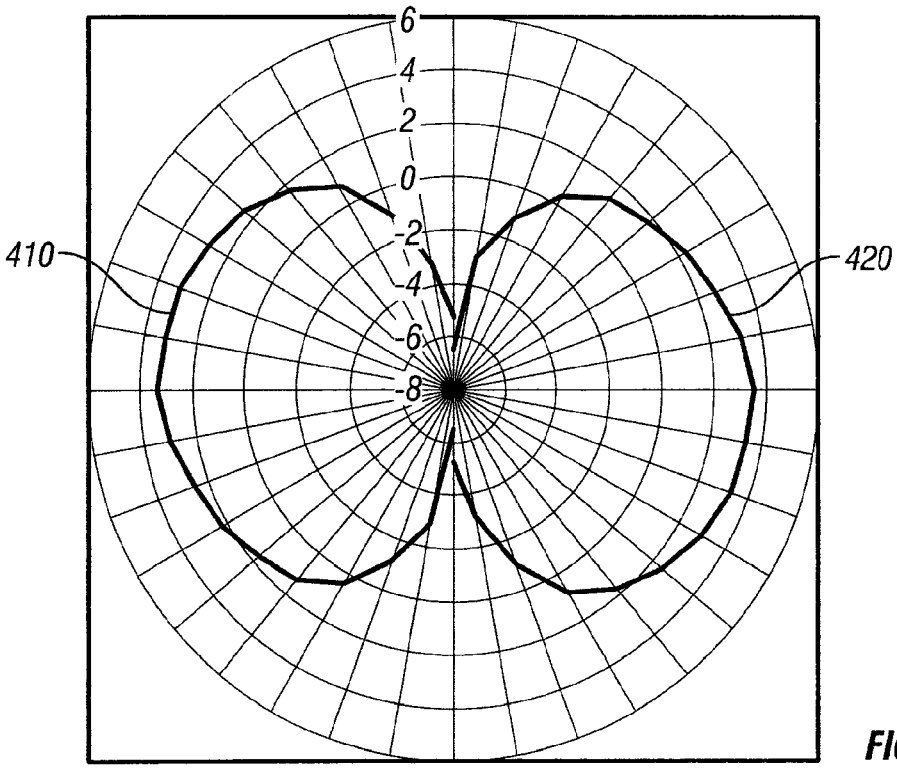
FIG. 4 is a plot of the relative gain of the antenna depicted in FIGS. 2 and 3 in the azimuth plane in two different modes of operation.

FIG. 4 is a plot of the relative gain of the antenna depicted in FIGS. 2 and 3 in the azimuth plane in two different modes of operation. Plot 410 represents the relative antenna gain when switch 135 is open and switch 125 is closed. Plot 420 represents the relative gain of the antenna depicted in FIGS. 2 and 3 when switch 125 is open and switch 135 is closed.

Figure 5:
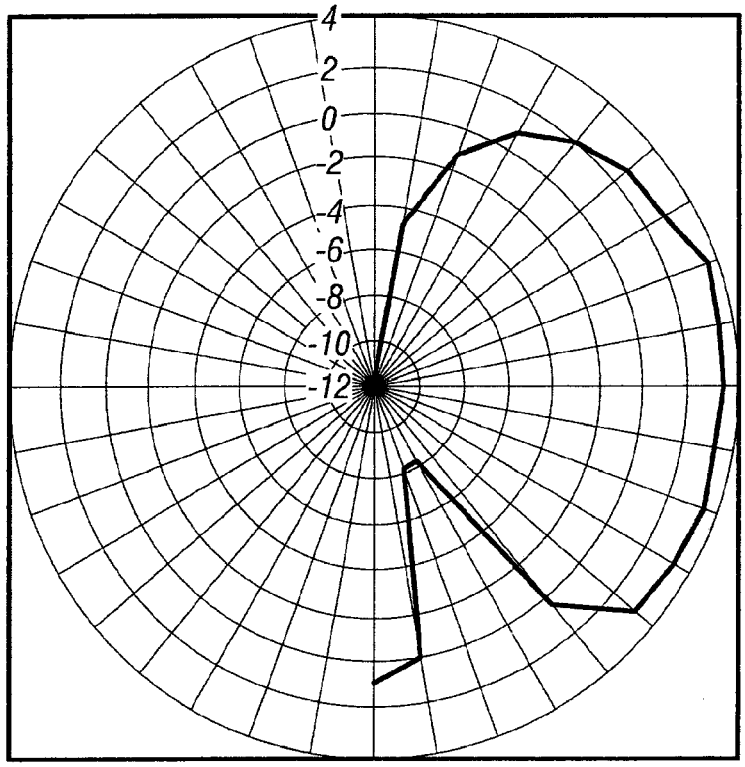
FIG. 5 is a plot of the relative gain of the antenna system depicted in FIGS. 2 and 3 in the elevation plane in one mode of operation.

FIG. 5 is a plot of the relative gain of the antenna system depicted in FIGS. 2 and 3 in the elevation plane when switch 125 is open and switch 135 is closed.

Figure 6A:
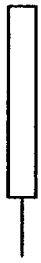
FIG. 6A-E are views of alternative configurations of the antenna elements.
Figure 6B:
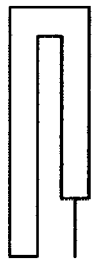
Figure 6C:
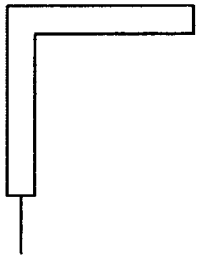
Figure 6D:
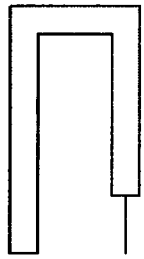
Figure 6E:
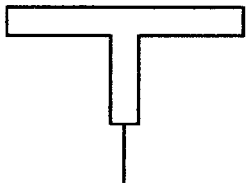

FIGS. 6A-E are views of alternative configurations of antenna elements that can be used to accommodate a wide variety of applications. FIG. 6A depicts a straight antenna element. FIG. 6B depicts a folded antenna element. FIG. 6C depicts a bent element. FIG. 6D depicts a folded bent element. FIG. 6E depicts a top loaded element. These elements can be used in place of the antenna elements depicted in FIGS. 1, 2 and 3. In particular, in situations where area is available on the board on which the antenna system is placed, the antenna element can be a traditional dipole formed with two straight elements. Additionally, for example, the folded elements provide an option for higher antenna impedance which can be useful for switch topologies that require a high terminating impedance. When the application requires a different shape, for example due to the surface area available for the elements, the elements can take other forms such as a bent antenna, a bent folded antenna, or a top loaded antenna.

Figure 7:
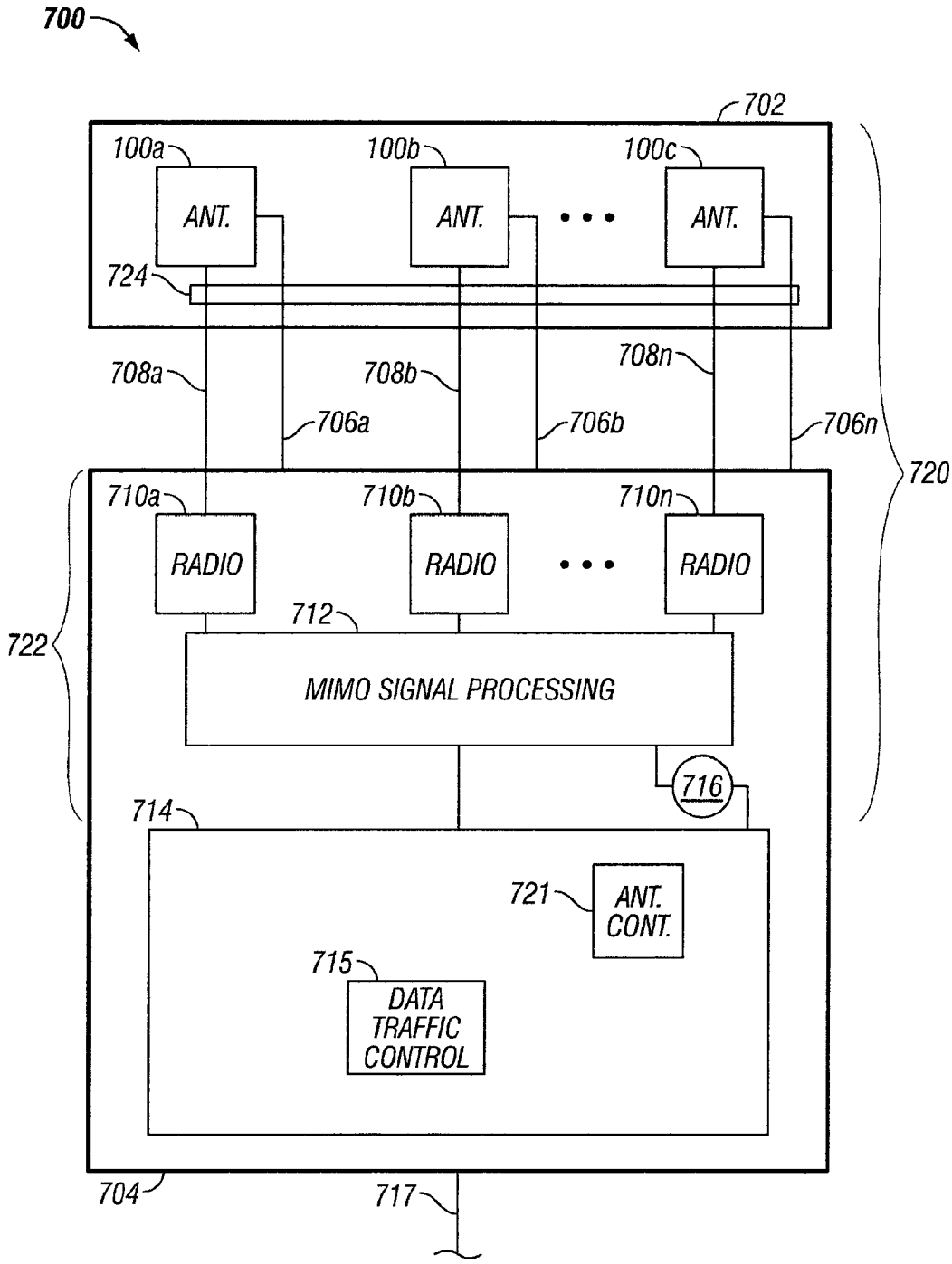
FIG. 7 is a functional block diagram of a wireless communication device.

Turning now to FIG. 7, FIG. 7 is a functional block diagram of an embodiment of a wireless communication device 700. For example, the wireless device can be a wireless router, a mobile access point or other type of wireless communication device. In addition, the wireless device 700 can employ MIMO (multiple-in multiple-out) technology. The communication device 700 includes a configurable antenna system 702 which is in communication with a radio system 704. The antenna system includes a plurality of configurable antennas 100*a-n*, such as the configurable antenna 100 described above in connection with FIGS. 1-3. In one embodiment, three configurable antennas are used with each of the antennas disposed in a plane orthogonal to the other two. However, more or fewer such configurable antenna can be used. A plurality of control lines 706*a-n* communicatively couple the antenna system 702 to the radio system 704 to provide a path for control signals for controlling the configurations of the configurable antennas 100*a-n*. A plurality of transmit and receive lines 708*a-n* couples the antenna system and the radio system for the transmission of transmitted and received radio signals. Though the number of transmit and receive lines and the number of control lines depicted corresponds with the number of antennas depicted. However, that is not necessary. More or fewer such lines can be used as can multiplexing and switching techniques. In one embodiment the antenna system includes a controller 724 which receives the control signals and the transmit and receive signals. The controller can route the signals to the appropriate antenna and radio.

The radio system 704 includes a radio sub-system 722. The radio sub-system 722 includes a includes a plurality of radio transmitter/receivers (radios) 710*a-n* and a MIMO signal processing module (the signal processing module) 712. The plurality of radios 710*a-n* are in communication with the MIMO signal processing module. The radios generate radio signals which are transmitted by the antenna system 702 and receive radio signals from the antenna system. In one embodiment each configurable antenna 100*a-n* is coupled to a single corresponding radio 710*a-n*. Although each radio is depicted as being in communication with a corresponding antenna element by a transmit and receive line, more or fewer such lines can be used. In addition, in one embodiment the radios can be controllably connected to various ones of the antennas by multiplexing or switching.

The signal processing module 712 implements the MIMO processing. MIMO processing is well known in the art and includes the processing to send information out over two or more radio channels on two or more of the antennas and to receive information via multiple radio channels and antennas as well. The signal processing module can combine the information received via the multiple antenna into a single data stream. The signal processing module may implement some or all of the media access control (MAC) functions for the radio system and control the operation of the radios so as to act as a MIMO system. In general, MAC functions operate to allocate available bandwidth on one or more physical channels on transmissions to and from the communication device. The MAC functions can allocate the available bandwidth between the various services depending upon the priorities and rules imposed by their QoS. In addition, the MAC functions operate to transport data between higher layers, such as TCP/IP, and a physical layer, such as a physical channel. The association of the functions described herein to specific functional blocks in the figure is only for ease of description. The various functions can be moved amongst the blocks, shared across blocks and grouped in various ways.

A central processing unit (CPU) 714 is in communication with the signal processor module 712. The CPU 714 may share some of the MAC functions with the signal processing module 712. In addition, the CPU can include a data traffic control module 715. Data traffic control can include, for example, routing associated with data traffic on a back haul connection 717, such as a DSL connection, and/or TCP/IP routing. A common or shared memory 716 which can be accessed by both the signal processing module and the CPU can be used. This allows for efficient transportation of data packets between the CPU and the signal processing module.

In one embodiment an antenna control module 721 is included in the CPU 714. The antenna control module determines the desired configuration for each of the antenna 100*a-n* and generates the control signals to be sent to the antenna system 702. In one embodiment, the antenna control module 721 operates above the MAC layer of the system. In response to the control signals, the configuration of one or more of the antennas is changed. In one embodiment, all of the antennas are configured in the same manner. For example, all of the antennas can be disposed in the same plane and all of the antennas can have their gain maximized in the same direction. Alternatively, each antenna can be individually configured. Further, the antennas can be configured into predetermined configurations.

The antenna control module 721 can be provided with direct or indirect communication to the antenna system 702, for example via control lines 706*a-n*. More or fewer control lines than those shown can be used. The control signals from the antenna control module 721 can be transmitted directly from the CPU to the antenna system 702 or can be transmitted via the other elements of the radio system 704 such as the signal processing module 712 or the radios 710*a-n*. Alternatively, the antenna control module 721 can reside on the signal processing module 712 or in one or more of the radios 710*a-n*.

In one embodiment the antenna control module 721 is provided with or has access to a signal quality metric for each received signal and/or transmitted signal on a communication link. The signal quality metric can be provided from the MIMO signal processing module 712. The MIMO signal processing module has the ability to take into account MIMO processing before providing a signal quality metric for a communication link between the wireless communication device 700 and a station with which the wireless communication device is communicating. For example, for each communication link the signal processing module can select from the MIMO techniques of receive diversity, maximum ratio combining, and spatial multiplexing each. The signal quality metric received from the signal processing module, for example, data through put or error rate, can vary based upon the MIMO technique being used. A signal quality metric, such as received signal strength, can also be supplied from one or more of the radios 710*a-n*. However, the radios would not take into account MIMO techniques, such as spatial multiplexing. The signal quality metric is used to determine or select the antenna configurations.

The above description of the disclosed embodiments is provided to enable any person skilled in the art to make or use the invention. Numerous modifications to these embodiments would be readily apparent to those skilled in the art, and the principals defined herein can be applied to other embodiments without departing from the spirit or scope of the invention. Thus, the invention is not intended to be limited to the embodiment shown herein but is to be accorded the widest scope consistent with the principal and novel features disclosed herein.

We claim:

1. A configurable antenna system comprising:

a first compound antenna element including a first upper element, a first lower element and a first switch controllably coupling the first upper element and the first lower element;

a second compound antenna element including a second upper element, a second lower element and a second switch controllably coupling the second upper element and the second lower element when the first upper element and the first lower element are not coupled;

wherein the first switch couples the first upper element and the first lower element when the second upper element and the second lower element are not coupled; and a printed circuit board with the first upper element and the second upper element are located on a first side of the printed circuit board and the first lower element and the second lower element are located on a second side of the printed circuit board.

2. The system of claim 1 further comprising an upper conductive path coupling the first upper element and the second upper element and a signal input coupled to the upper conductive path at a reflective distance from the fist and second upper elements.

3. The system of claim 2 wherein control signals to the first switch are provided via the upper conductive path.

4. The system of claim 1 further comprising a ground plane and wherein the first lower element and the second lower element are reflections in a ground plane.

5. The system of claim 2 further comprising "a lower conductive path coupling the first lower element and the second lower element".

wherein the upper conductive path and the lower conductive path provide a bias voltage to the first switch and the second switch.

6. The system of claim 5 wherein the lower conductive path is coupled to a ground connection.

7. The system of claim 6 wherein the first switch comprises a pin diode and the second switch comprises a pin diode.

8. An antenna assembly with multi-use elements comprising:

a supporting structure having a first surface and a second surface opposite the first surface;

a first upper element on the first surface of the supporting structure;

a first lower element on the second surface of the supporting structure;

a first switch controllably coupling the first upper element and the first lower element responsive to a control signal;

a second upper element on the first surface of the supporting structure;

a second lower element on the second surface of the supporting structure; and a second switch controllably coupling the second upper element and the second lower element responsive to a control signal to couple the second upper element and the second lower element when the first upper element and the first lower element are not coupled and to not couple the second upper element and the second lower element when the first upper element and the first lower element are coupled.

9. The assembly of claim 8 further comprising an upper conductive path coupling the first upper element and the second upper element; a lower conductive path coupling the first lower element and the second lower element; and wherein the upper conductive path is on the first surface of the supporting structure and the lower conductive path is on the second surface of the supporting structure in a location complimentary to the upper conductive path so as to form a ground plane portion of a strip line connection with the upper conductive path.

10. The assembly of claim 9 further comprising a signal input coupled to the upper conductive path at reflective distances from the fist upper element and the second upper element.

11. The assembly of claim 10 wherein the lower conductive path is coupled to a ground connection.

12. The system of claim 8 wherein the first switch comprises a first pin diode and the second switch comprises a second pin diode.

13. The system of claim 9 wherein the upper conductive path and the lower conductive path provide the bias voltage to the first pin diode and the second pin diode.

* * * * *